US012709452B2

(12) United States Patent
Madanagopal et al.

(10) Patent No.: US 12,709,452 B2
(45) Date of Patent: Aug. 18, 2026

(54) INSULATED PACKAGING SYSTEM USING CELLULOSE MATERIALS

(71) Applicant: LIFE TECHNOLOGIES CORPORATION, Carlsbad, CA (US)

(72) Inventors: Arunkumar Madanagopal, San Diego, CA (US); Kenneth Orellana, Carlsbad, CA (US); Paulius Adomelis, Charlestown, MA (US)

(73) Assignee: LIFE TECHNOLOGIES CORPORATION, Carlsbad, CA (US)

( * ) Notice: Subject to any disclaimer, the term of this patent is extended or adjusted under 35 U.S.C. 154(b) by 600 days.

(21) Appl. No.: 18/191,670

(22) Filed: Mar. 28, 2023

(65) Prior Publication Data

US 2023/0322471 A1 Oct. 12, 2023

Related U.S. Application Data

(60) Provisional application No. 63/327,961, filed on Apr. 6, 2022.

(51) Int. Cl.
*B65D 81/38* (2006.01)

(52) U.S. Cl.
CPC ..... *B65D 81/3848* (2013.01); *B65D 81/3813* (2013.01)

(58) Field of Classification Search
CPC ..... B65D 81/3848; B65D 81/3851; B65D 81/386; B65D 81/3863; B65D 71/0096; B65D 5/22; B65D 5/3621
See application file for complete search history.

(56) References Cited

U.S. PATENT DOCUMENTS

| | | | | |
|---|---|---|---|---|
| 4,582,198 A * | 4/1986 | Ditton | B65D 71/0096 229/160 |
| 5,125,567 A * | 6/1992 | McClure | B65D 5/22 229/117.17 |
| 2010/0001056 A1* | 1/2010 | Chandaria | B65D 5/3621 229/126 |
| 2021/0253330 A1* | 8/2021 | Madanagopal | B65D 81/386 |

FOREIGN PATENT DOCUMENTS

| | | | |
|---|---|---|---|
| AU | 2018260911 | A1 | 5/2020 |
| GB | 2592918 | A | 9/2021 |
| WO | WO-2007007139 | A1 | 1/2007 |
| WO | WO-2020222943 | A1 | 11/2020 |

OTHER PUBLICATIONS

PCT/US2023/016602, International Search Report and Written Opinion, Jul. 24, 2023, 13 pages.

* cited by examiner

*Primary Examiner* — Andrew T Kirsch

(57) ABSTRACT

The present disclosure relates to temperature insulated packaging systems and related methods of manufacture and use that can be used for shipping perishable materials. An insulative insert is formed by folding one or more pieces of stock cellulose material along predetermined fold lines and folding slots to form an insert in a folded configuration suitable for insertion as an insulative liner within a container for use in shipment.

17 Claims, 13 Drawing Sheets

| | Insert A | Insert B |
|---|---|---|
| Step 1: | 2X Fold corrugate insert  | Fold insulative paper  |
| Step 2: | 2X Place insulation  | Fold by rolling technique  |
| Step 3: | 2X Fold & glue insert by automated process  | Place insulation into corrugated box  |
| Step 4: | Fold and connect pieces  | |
| Step 5: | Place insulated material into corrugated box  | |

INSULATED PACKAGING SYSTEM USING CELLULOSE MATERIALS

CROSS-REFERENCE TO RELATED APPLICATIONS

This application claims the benefit of U.S. Provisional Application No. 63/327,961, filed on Apr. 6, 2022, entitled "Insulated Packaging System using Cellulose Materials," the content of which is incorporated by reference herein in its entirety.

BACKGROUND

Technical Field

This disclosure relates to insulative inserts formed from a cellulose material and packaging systems that incorporate such inserts.

Related Technology

To facilitate and extend the shelf life of some perishable products from manufacture through distribution, a temperature-controlled supply chain (sometimes referred to as a cold chain) is often required. An unbroken cold chain, for example, generally includes an uninterrupted series of storage and distribution activities, which consistently maintain a product's environment within a desired, relatively low, temperature range. Consequently, packaging used in cold chain shipments must often maintain a product's environment within the desired, relatively low temperature range for an extended period of time, thereby ensuring that the product's temperature stays within the proper temperature range for the entire duration of the cold chain, from manufacture to end use.

Products requiring cold chain shipment are typically cooled prior to shipment, then placed within a thermal insulating material, and shipped with only a modicum of ice or refrigerant to absorb the heat that flows from the environment external to the packaging through the insulation. For many years, molded expanded polystyrene ("EPS") containers have been used as a thermal insulating material for cold chain shipments. Perishable goods, for example, are generally placed within EPS containers (i.e., coolers), which are then in turn placed within cardboard shipping boxes.

While EPS containers provide satisfactory insulating qualities, as well as being generally light weight, EPS containers also pose issues. EPS is an "expanded," non-compressible material that consists of numerous small air bubbles formed in a polystyrene matrix. Accordingly, EPS's poor volume efficiency may increase shipment costs when transporting empty containers to a location for use, increase warehousing costs when storing containers prior to use, and increase product shipment costs by providing a container that is often larger than may be needed to contain the product, thereby costing more to ship and necessitating more coolant.

Growing concerns for the environment, including, concerns about global warming and excessive packaging waste, have also driven various environmental concerns regarding EPS containers. EPS's poor volume efficiency, for example, results in a greater amount of container waste material that needs to be recycled and/or disposed of. Further, EPS is relatively difficult to recycle.

Consequently, various "green" or environmentally friendly packaging insulators, which use inflated air, foamed corn starch, or recycled EPS foam, have been developed for cold chain shipment applications. Such "green" options, however, still generally lack satisfactory volume efficiency (i.e., size of product to size of packaging) and viable (i.e., simple) recycling options. To replace conventional EPS and other insulating packaging materials, it may therefore be desirable to provide insulating packaging systems that are not only made of a renewable resource, but also provide satisfactory insulating qualities and volume efficiency, and are relatively simple to manufacture.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale, wherein:

FIGS. 2A-2G illustrate an embodiment of an insert formed from a cellulose material and configured for insulating an interior volume of a container, wherein FIG. 2A illustrates an example stock cellulose material with features that enable folding, FIGS. 2B-2F illustrate the insert at various stages of an example folding process for converting the stock cellulose material into a folded configuration suitable for insertion into a container, and FIG. 2G illustrates the finalized folded configuration of the insert;

FIGS. 3A-3F illustrate another embodiment of an insert formed from a cellulose material and configured for insulating an interior volume of a container, wherein FIG. 3A illustrates an example stock cellulose material with features that enable folding, FIGS. 3B-3D illustrate the insert portion at various stages of an example folding process for converting the stock cellulose material into a folded insert portion, FIG. 3E illustrates a finalized folded insert portion, and FIG. 3F illustrates connection of two insert portions to form a combined insert suitable for insertion into a container;

DETAILED DESCRIPTION

Overview of Insulative Packaging Systems

Figure 1A:
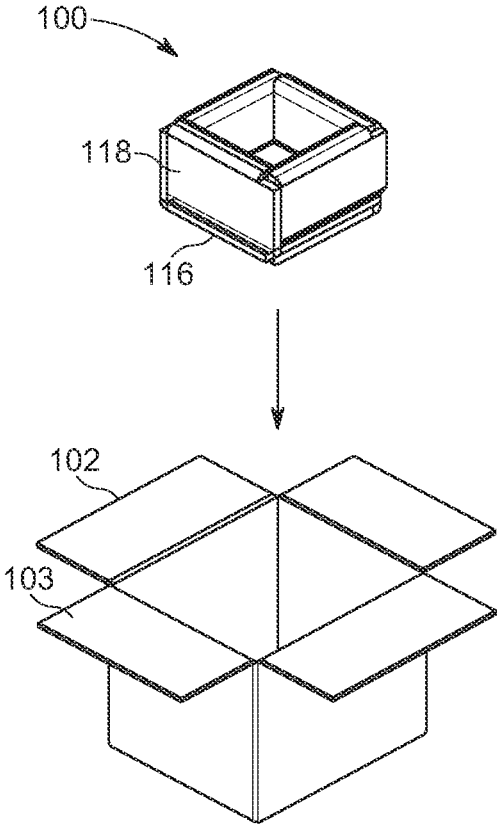
FIGS. 1A-1C illustrate an overview of a packaging system including a container and an insulative insert formed from cellulose materials, FIGS. 1A and 1B showing the packaging system in a partial exploded view and FIG. 1C showing the packaging system with the insulative insert positioned within the container.

The present disclosure relates to temperature insulated packaging systems and related methods of manufacture and use that can be used for shipping perishable materials, such as biological materials, food products, pharmaceutical products, and chemicals, that need to be shipped at a controlled temperature to maintain their viability, efficacy, or usefulness. Such packaging systems can be used as part of a cold chain shipping process, for example.

The disclosed packaging systems are preferably formed of cellulose materials or are at least primarily formed of cellulose materials. The use of cellulose materials beneficially minimizes or avoids the use of conventional packaging insulation materials, such as expanded polystyrene (EPS) foam and/or other polymers, that are more difficult to recycle, not amenable to composting, and contribute more significantly to durable landfill wastes.

The disclosed packaging systems represent an improvement over conventional insulative packaging systems. As discussed above, many conventional packaging systems incorporate EPS or other polymer materials that are difficult to recycle, compost, or otherwise reuse in a sustainable manner.

Other packaging systems utilize cellulose materials and avoid such problems, but these cellulose-based packaging systems often significantly suffer in insulative performance relative to the polymer-based counterparts. Further, previous cellulose-based insulative packaging systems often require relatively complicated manufacturing steps to get from a suitable piece of stock cellulose material (such as paperboard) to a folded configuration ready to function as a liner for placement within a container (such as a standard cardboard box).

For example, previous cellulose-based insulative packaging systems may require an outer covering or sleeve that must be wrapped around or otherwise enclosed around inner layers of cellulose material. Such arrangements require additional manufacturing steps and thus complicate the manufacturing process. In contrast, the disclosed insulative inserts are designed so that an unfolded insert can be converted to a folded configuration ready for insertion into a container following a relatively simple folding process.

Another limitation of prior cellulose-based insulative packaging systems relates to structuring the insert to achieve sufficient thickness. Cellulose materials such as paperboard typically come with uniform thickness for a given piece of stock material. Of course, the stock cellulose material can be layered until a desired thickness is achieved, but it can be difficult to position the layers in specific, desired areas of the insert without adding excessive thickness to other areas. The insulative inserts disclosed herein are beneficially configured to provide sufficient layering of the stock cellulose material, and thus sufficient thickness of the insert, as a direct result of the simple folding process that puts the insert in the folded configuration.

Of course, stock cellulose material can be cut into separate pieces and arranged as desired with glue, tape, or the like, but this undesirably adds complexity to the manufacturing process. In contrast, the disclosed insulated inserts are configured such that at least the bottom and sidewall portions of the insert are readily formed from one or two pieces of stock cellulose material, without the need for cutting and reattaching of separate panels, and without the need to use glue, tape, or other adhesives.

Certain embodiments are particularly useful for insulating a cold source and one or more items for shipment when the cold source is dry ice (i.e., solid carbon dioxide). Many items such as biological materials, chemical reagents, and the like are shipped with dry ice as opposed to cold gel packs or other cold sources because of regulations and/or shipping temperature requirements. The insulative inserts described herein beneficially form a multi-layered bottom portion that has additional thickness relative to the sidewall portions or top portion of the insert. For example, as described in greater detail below, the insert can fold so that the bottom portion has four layers while the sidewalls have three layers. This beneficially provides additional insulation at the location where most of the heat transfer is likely to take place when dry ice is used as the cold source (because of carbon dioxide's higher density relative to dry air).

Figure 1B:
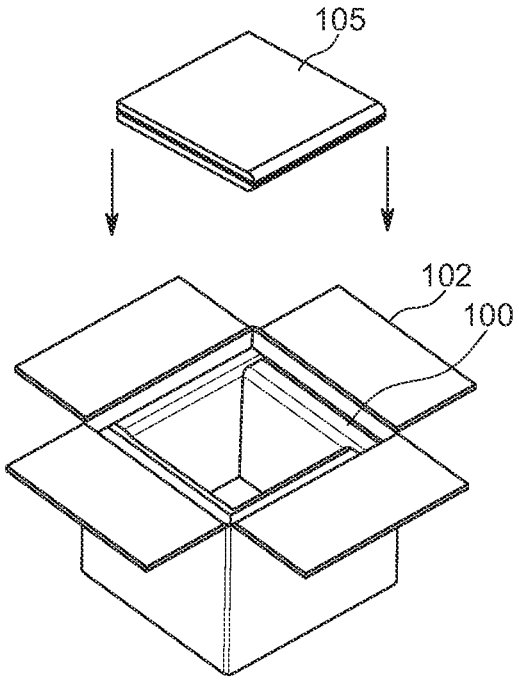
Figure 1C:
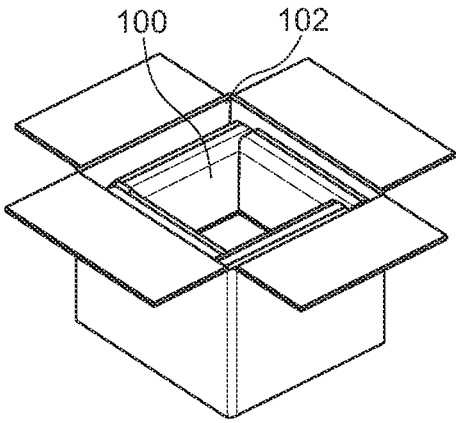

FIGS. 1A-1C illustrate an example packaging system including an insulative insert 100 and a container 102. The insert 100 is formed from a cellulose material and includes a bottom 116 and a sidewall 118. The insert 100 is shown here in a finalized, folded configuration suitable for insertion into the container 102. As shown in FIG. 1B, a top portion 105 sized to lie upon or fit within the sidewall 118 may be placed on or contacted with the sidewall 118 to complete the insert 100 and fully enclose the interior volume to be insulated. The top portion 105 may be made from the same type of stock material as the other portions of the insert 100. In other embodiments, the top portion 105 may be made from a different stock material as compared to the other portions of the insert 100.

As described in greater detail below, the insert 100 may be provided as an unfolded section of stock cellulose material that is capable of folding into the illustrated folded configuration. The unfolded insert beneficially includes features that minimize the time and effort required to convert to the folded configuration shown in FIGS. 1A-1C. Moreover, the insert 100 is configured to provide multiple layers of the stock cellulose material when formed into the folded configuration, even where the unfolded insert is initially provided as a single layer of cellulose material.

The container 102 is shown here as a standard cubic "box" with typical moveable flaps 103 for accessing the interior volume of the container 102. The insulative inserts 100 described herein are not limited to such containers 102. For example, packaging containers with round, curved, rectangular, or other polygonal cross-sectional shapes may also be utilized. The size of container 102, and thus the size of interior volume, can vary depending in part on the size of the item to be shipped and the duration that the item needs to be insulated/cooled. In some embodiments, the container 102 is sized so that interior volume is about 1,500 $cm^3$, 3,000 $cm^3$, 8,000 $cm^3$, 0.027 $m^3$, 0.125 $m^3$ or is in a range with endpoints defined by any two of the foregoing values. Other volumes can also be used.

The container 102 and/or insert 100 may be formed from a variety of materials, such as from one or more sheets of cellulose material, such as wood, cotton, cloth, and/or paper. More commonly, container 102 and/or insert are comprised of one or more sheets of paper such as paperboard. The paperboard can be flat (i.e., have no corrugation), corrugated, or a combination thereof. Paperboard commonly comprises cardboard, such as corrugated cardboard. Thus, container 102 can be a conventional cardboard packaging box. The material used to form container 102 is typically foldable and has a thickness in the range of between 0.8 mm and 5 mm and more commonly between 0.8 mm and 3 mm or between 1 mm and 3 mm. Other thicknesses may be used according to particular application needs.

In some embodiments, the container 102 and/or the insert include a water-impermeable coating on respective exterior and/or interior surfaces. The coating may be a polymer, for example. The coating is preferably a biodegradable polymer material such as a polyhydroxyalkanoate (PHAs) like poly-3-hydroxybutyrate (PHB), poly-3-hydroxyvalerate (PHV), and polyhydroxyhexanoate (PHH), polylactide (PLA), polysaccharide-based polymers (e.g., based on starch, cellulose, chitosan, and/or alginate) including cellulose acetate, or other suitable polymers that are at least more biodegradable than conventional petroleum-based polymers, and copolymers thereof. The coating can be sprayed, painted, printed, or otherwise applied during or after the formation of the stock material used to form insert 100 and/or container 102. The coating could also be applied while insert 100 and/or container 102 are being formed or after insert 100 and/or container 102 are formed.

The packaging system may further comprise a cold source and one or more items for shipping. The cold source and one or more items for shipping may be placed within the insulative insert 100, which is received into the container 102 and functions to line the inner surfaces of the container 102 to thereby insulate the cold source and one or more items for shipping. Examples of items or materials that can be shipped with the disclosed packaging systems include biological materials, food products, beverages, pharmaceutical drugs, chemicals, and other materials that need to be shipped at lower temperatures to maintain their viability. Examples of biological materials include reagents, cell cultures, vaccines, cryopreserved cells, competent cells, proteins, enzymes, and antibodies.

The cold source may include dry ice, ice, one or more gel packs, phase change materials, other cold sources for keeping materials cooled for relatively short durations, and combinations thereof. Dry ice is commonly used in pellet form, in slab form, or in other desired shapes and sizes. The cold source can also comprise a separate container in which the dry ice, ice, frozen gel pack, and phase change materials are housed. Examples of such containers include bags, bottles, plastic containers, and the like.

In some embodiments, the container 102 may be omitted or replaced with a bag, carton, shell, canister, or other form of outer packaging structure. In some embodiments, more than one container 102 may be included. For example, one or more additional containers may be utilized as a safety measure in case the insert 100 and/or innermost container 102 fails.

As previously noted, the size of container 102 is dependent upon the size of the one or more items for shipping and the duration that the item(s) need to be kept cold. That is, as the size of the item(s) increases and/or the time increases for retaining the item(s) at lower temperatures, the size of container 102 increases. By increasing the size of container 102, more space is provided for additional quantities of cold source. The packaging system is typically configured to hold the interior contents to a temperature of less than about 11° C., 8° C., 2° C., or −10° C. for a period of time of at least 10 hours, 15 hours, 20 hours, 30 hours, 40 hours, 50 hours, or for a range of time between any two of the foregoing values. Of course, conditions will also depend on other factors such as expected ambient temperature.

In some embodiments, not all the space within the interior of the insert 100 is needed. In such situations, a filler can be placed within the insert 100 to occupy the unneeded space. In some embodiments, the filler comprises conventional dunnage, wadding stuffing, padding, or other packaging material used to occupy space and that is typically recyclable and/or biodegradable.

Example Insulative Inserts

Figure 2A:
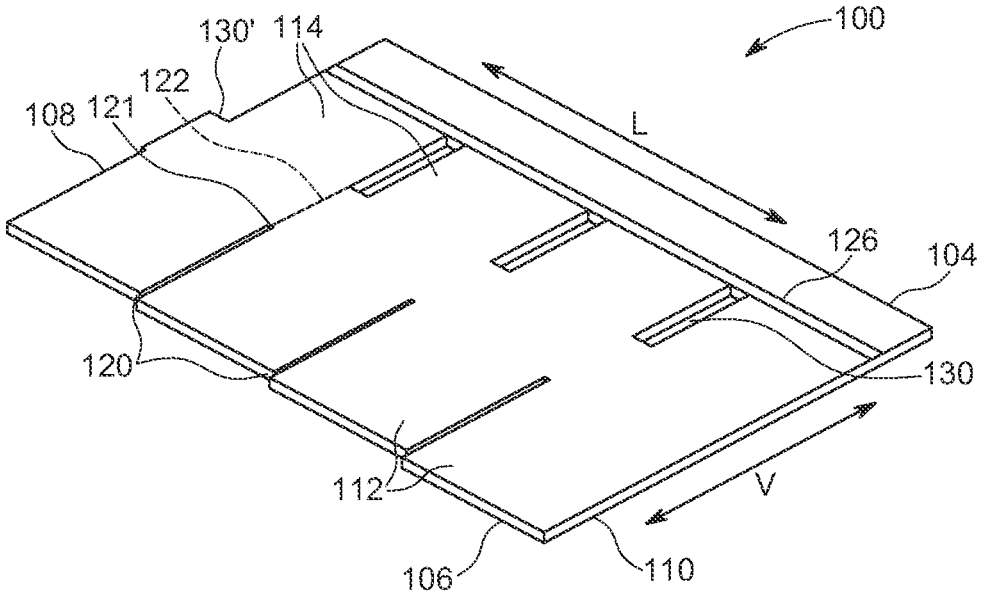

FIGS. 2A-2G illustrate an embodiment of an insert 100 formed from a cellulose material and configured for insulating an interior volume of a container. FIG. 2A illustrates the insert 100 as a single, unfolded piece of stock cellulose material. As shown, the insert 100 includes an upper edge 104, a lower edge 106, a left edge 108, and a right edge 110. As used herein, the direction extending from the upper edge 104 to the lower edge 106, and vice versa, is referred to as the vertical direction (V), and the direction extending from the left edge 108 to the right edge 110, and vice versa, is referred to as the lateral direction (L). In other words, the vertical direction (V) is substantially parallel to the left edge 108 and the right edge 110, whereas the lateral direction (L) is substantially parallel to the upper edge 104 and the lower edge 106.

The illustrated insert 100 includes a plurality of folding slots 120. Each folding slot 120 begins at the lower edge 106 and extends in the vertical direction toward the upper edge 104 until reaching a folding slot terminus 121. Each folding slot 120 also defines a vertical fold line 122 (one of which is shown in dashed line). Each vertical fold line 122 extends from a corresponding folding slot terminus 121 in the vertical direction toward the upper edge 104. Each folding slot 120 also defines a primary lateral fold line 124 (best seen in FIG. 2B). Each primary lateral fold line 124 extends in the lateral direction from a corresponding folding slot terminus 121 (or area substantially near the terminus 121) toward the left edge 108 and/or the right edge 110. The illustrated embodiment shows primary lateral fold lines 124 extending from folding slot termini 121 toward the left edge 108, with the right most primary lateral fold line 124 extending from the right edge 110 toward the right most folding slot 120.

Sections of the insert 100 (also synonymously referred to herein as "panels" of the insert 100) disposed below respective primary lateral fold lines 124 are defined as bottom sections 112, and sections above respective primary lateral fold lines 124 are defined as sidewall sections 114. Folding the insert 100 along the primary lateral fold lines 124 and along the vertical fold lines 122 forms a folded configuration (see FIG. 2G) with a sidewall 118 formed by the sidewall sections 114 and an insert bottom 116 formed by the bottom sections 112.

In the illustrated embodiment, each folding slot 120 has a slightly different length. Because of this, each primary lateral fold line 124 is vertically offset from the other primary fold lines 124. In other words, the distance from the lower edge 106 is different for each primary lateral fold line 124, and the distance from the upper edge 104 is different for each primary lateral fold line 124. In preferred embodiments, the folding slots 120 are arranged with successively shorter or longer lengths such that the primary lateral fold lines 124 are successively lower or higher.

In the illustrated embodiment, each folding slot 120, moving from the left edge 108 to the right edge 110, is successively shorter from the previous one. Accordingly, each primary lateral fold line 124, moving from the left edge 108 to the right edge 110, is successively lower than the previous one. The vertical offset distance from one primary lateral fold line 124 to the next may be approximately the thickness of the stock cellulose material used to form the insert 100. As described below, this beneficially allows the bottom sections 112 to layer with one another to form the multi-layered bottom 116 when the insert 100 is converted to the folded configuration.

The illustrated insert 100 also includes a series of cutouts 130. As shown, the cutouts 130 may be vertically aligned with a corresponding folding slot 120 (and thus a corresponding vertical fold line 122). One of the cutouts 130 is an edge cutout 130' that is partially coincident with one of the side edges of the insert 100 (the left edge 108, in this example). The edge cutout 130' is thus open to one side but otherwise functions as the other cutouts 130. The general reference to cutout(s) 130 will thus be inclusive of the edge cutout 130' unless specified otherwise.

Each cutout 130 is disposed to be positioned at a corner edge of the sidewall 118 when the insert is formed into the folded configuration. The cutouts 130 are wider (in the lateral direction) than the folding slots 120. Each cutout 130 provides clearance to enable folding of adjacent sections of the insert 100 along the corresponding vertical fold lines 122 such that there is sufficient clearance to form the corner edges where adjacent sections of the sidewall 118 meet.

The cutouts 130 of the illustrated embodiment are disposed between the primary lateral fold lines 124 and the upper edge 104 of the insert 100. As shown, the cutouts 130 (except for the edge cutout 130') do not extend to the upper edge 104. However, in other embodiments, one or more of the cutouts 130 extend all the way to the upper edge 104 to form an open end. The cutouts 130 are typically the same size, though an insert may have cutouts 130 of different size in other embodiments.

The illustrated cutouts 130 are aligned with one another along the lateral direction. That is, the lower edges of each cutout 130 are aligned with one another and the upper edges of each cutout 130 are aligned with one another. Other embodiments may include non-aligned cutouts 130. However, aligned cutouts 130 are preferred in order to properly place the cutouts 130 to assist in forming corner edges when the insert 100 is converted to the folded configuration.

For each cutout 130, a distance between the upper edge of the cutout 130 and the upper edge 104 of the insert 100 is equal to or less than the length of the cutout 130. Similarly, for each cutout 130, a distance between the lower edge of the cutout 130 and a corresponding primary lateral fold line 124 is equal to or less than the length of the cutout 130. Positioning the cutouts 130 in this manner with respect to the primary lateral fold lines 124 and the upper edge 104 ensures that the cutouts 130 will be located at the corner edges of the sidewall 118 when the insert 100 is folded.

An example process for converting the unfolded insert 100 (shown in FIG. 2A) to the folded configuration (shown in FIG. 2G) will now be discussed. One or more of the various fold lines (e.g., vertical fold lines 122, primary lateral fold lines 124, upper secondary fold line 126, and lower secondary fold line 128) may be pre-creased for easier folding during subsequent manufacturing processes and/or by the user but need not necessarily be pre-creased. While some fold lines may be shown as two adjacent and parallel lines, this is intended to account for the curvature along the fold line once folded, and for simplicity such lines will be referred to herein as a single fold line. Such curvature will vary according to the thickness of the stock cellulose material utilized.

With reference to FIG. 2A, the insert 100 includes an upper secondary fold line 126 substantially aligned with the upper edges of the cutouts 130. The upper secondary fold line 126 extends laterally from the left edge 108 to the right edge 110 of the insert 100. Folding the stock cellulose material of the insert 100 along the upper secondary fold line 126 provides the configuration shown in FIG. 2B. As shown, folding along the upper secondary fold line 126 essentially functions to add another layer to the sidewall sections 114 of the insert.

Figure 2B:
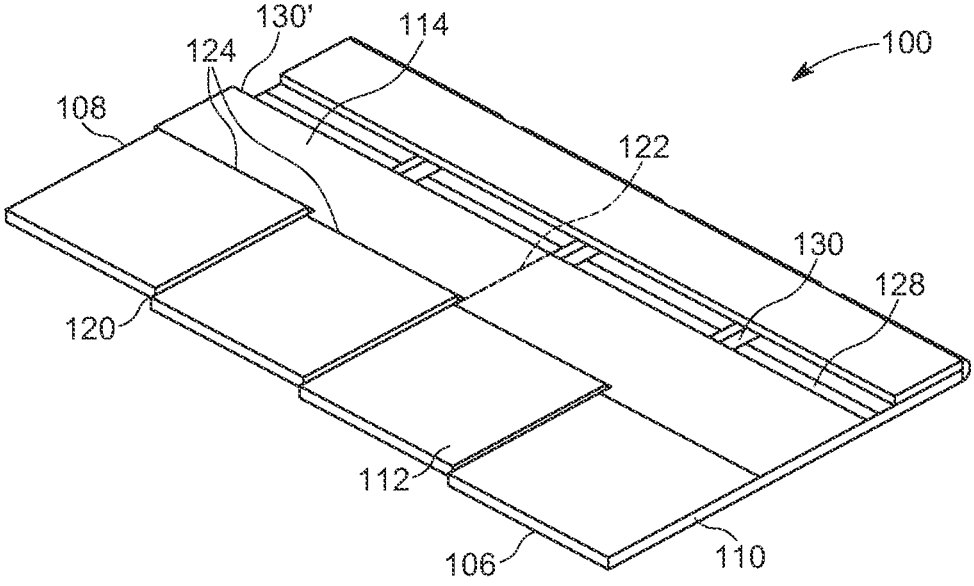

With reference to FIG. 2B, the insert 100 includes a lower secondary fold line 128 substantially aligned with the lower edges of the cutouts 130. The lower secondary fold line 128 extends laterally from the left edge 108 to the right edge 110 of the insert 100. Folding the stock cellulose material of the insert 100 along the lower secondary fold line 128 provides the configuration shown in FIG. 2C. Folding along the lower secondary fold line 128 essentially functions to add another layer to the sidewall sections 114 of the insert 100.

Figure 2C:
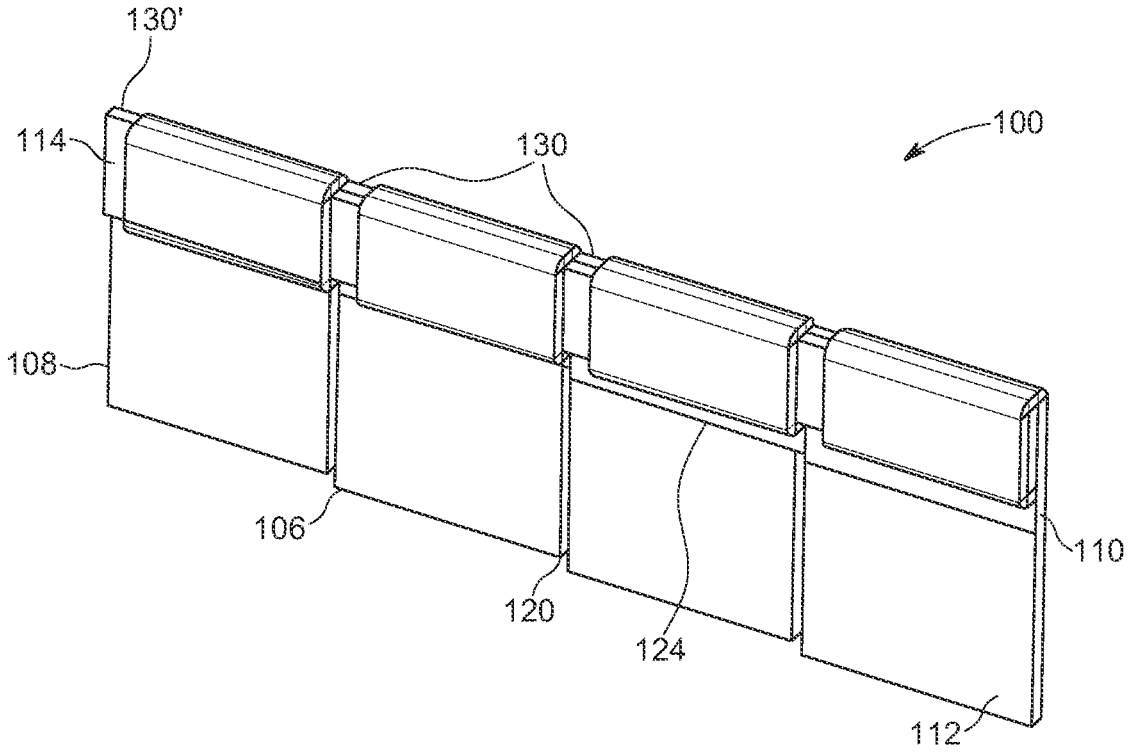

As shown in FIG. 2C, the sidewall sections 114 now have three layers, except at the areas corresponding to the cutouts 130. The folding slots 120 define and separate the bottom sections 112. Folding approximately 90° along each of the primary lateral fold lines 124 brings each bottom section 112 upward toward its corresponding sidewall section 114 to form essentially a right angle and provide the configuration of FIGS. 2D and 2E.

Figure 2D:
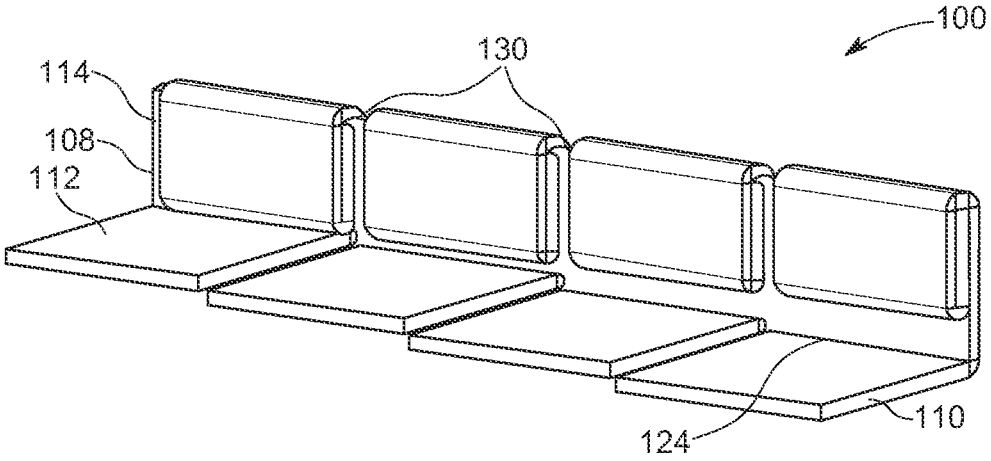
Figure 2E:
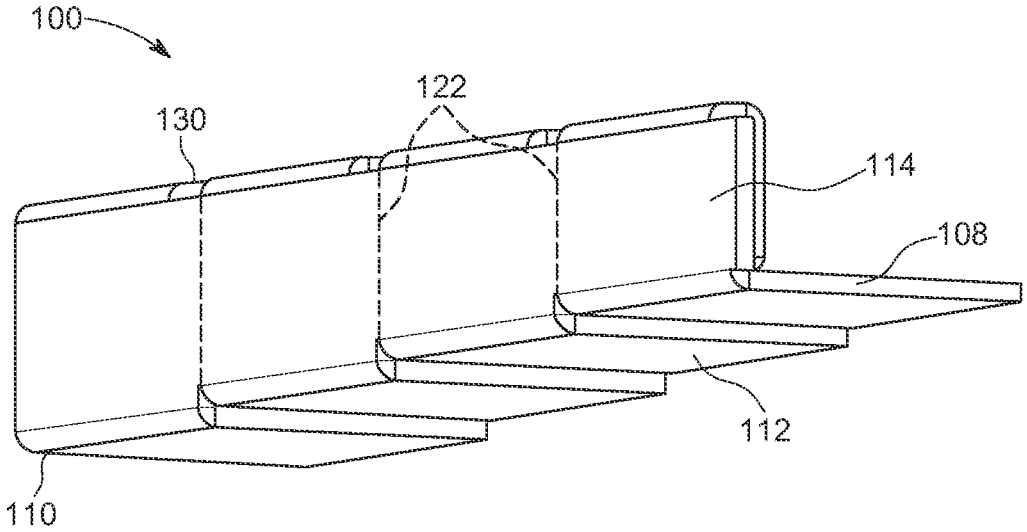

FIG. 2D shows a front perspective view, whereas FIG. 2E shows a rear perspective view, of the insert 100 at this stage of the folding process. These views illustrate that each bottom section 112 is offset in height from the others as a result of the vertical offset between each of the primary lateral fold lines 124. These views further show that sidewall sections 114 have three layers, except at the areas corresponding to the cutouts 130.

Figure 2F:
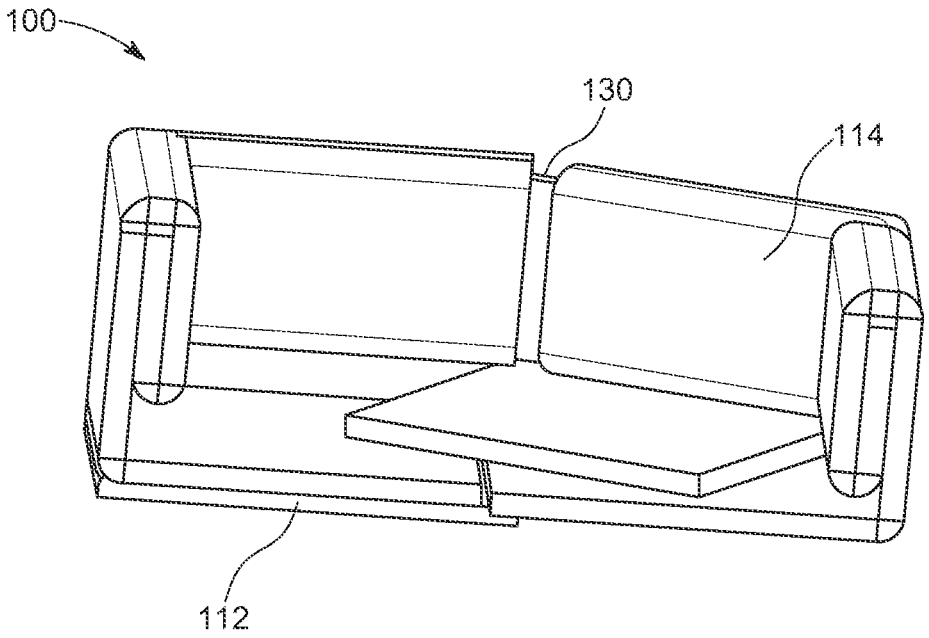

From the configuration of FIGS. 2D and 2E, the insert 100 may be folded (as shown in FIG. 2F) inward along the vertical fold lines 122 to layer the bottom sections 112 together and to bring the sidewall sections 114 together to form the perimeter of the finalized insert. The gaps corresponding to the cutouts 130 provide spaces for the multi-layered portions of the sidewall sections 114 to contact each other during folding and form a full, essentially contiguous multi-layered sidewall perimeter. In other words, once folded, substantially the entire inner surface of the sidewall 118 is multi-layered, with any single-layered portions being disposed along outer surfaces of corner edges.

Figure 2G:
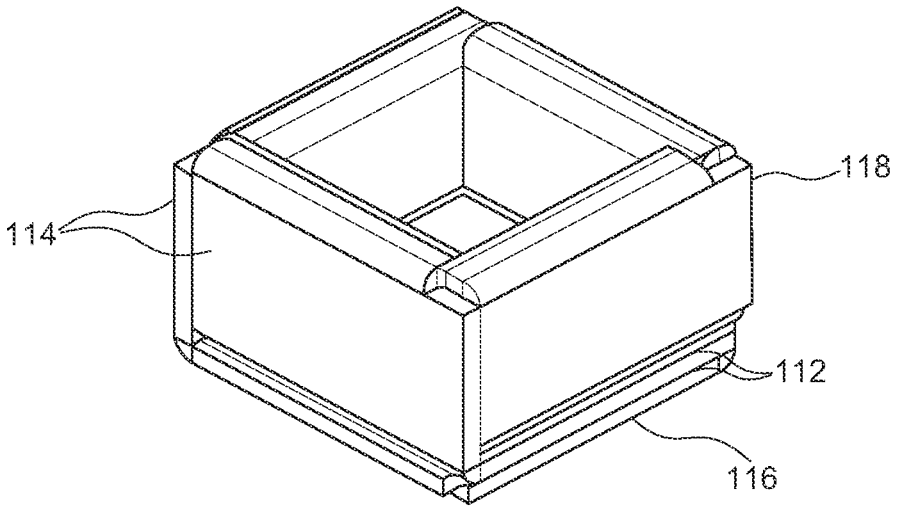

The folded configuration shown in FIG. 2G thus includes a sidewall 118 with three layers of the stock cellulose material and a bottom 116 with four layers of the stock cellulose material. The multiple layer construction beneficially increases the insulative capacity of the insert 100, while still allowing the initial, unfolded piece of stock cellulose material to have a relatively smaller thickness so as to be amenable to folding. In other words, although other insulative inserts with similar wall thicknesses could be made by forming the walls the desired thickness to begin with and then assembling the walls, such inserts could not be made from a uniform piece of stock cellulose material. That is, the disclosed inserts 100 can be formed from an initial, thinner piece of stock material amenable to folding and easy manufacture, that nonetheless forms a suitably thick insert upon folding.

FIGS. 3A-3F illustrate another embodiment of an insert 200 formed from a cellulose material and configured for insulating an interior volume of a container. The insert 200 (and its subpart insert portions 201) share many features with the insert 100 described above. The above description of insert 100 is therefore applicable to insert 200 and insert portions 201 except where specified otherwise.

Figure 3A:
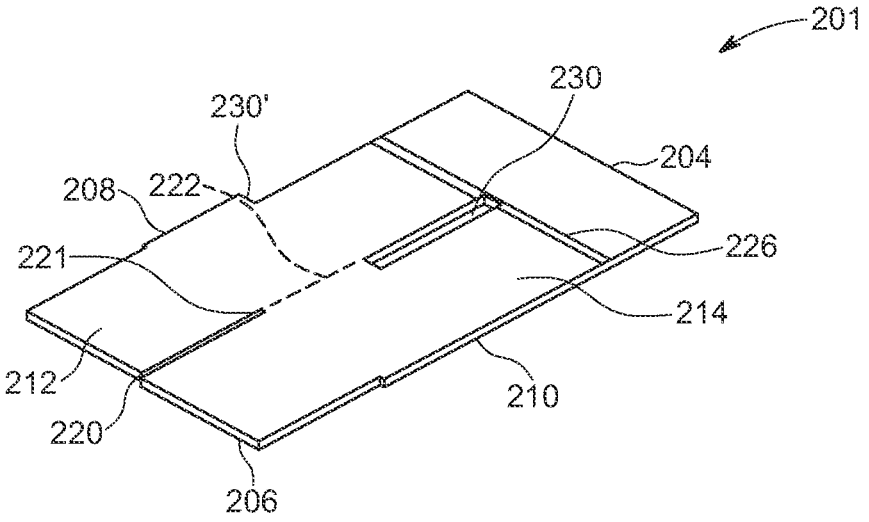
Figure 3B:
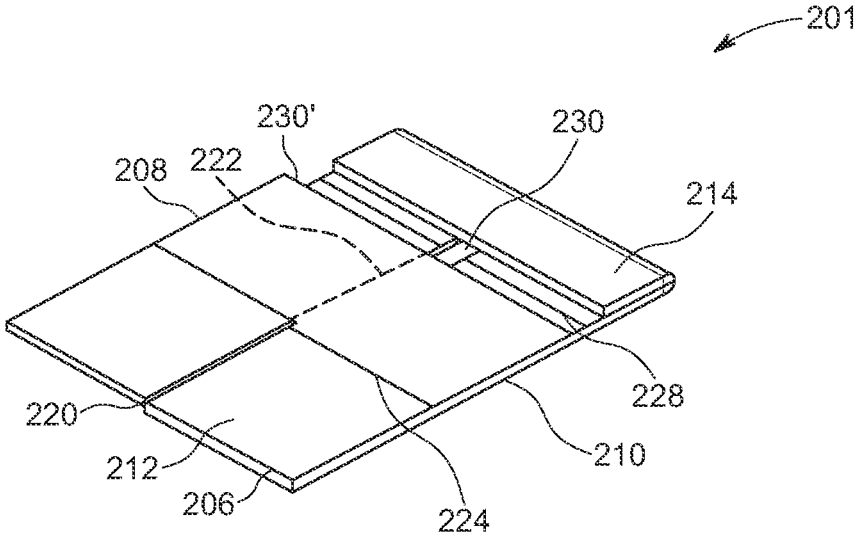
Figure 3C:
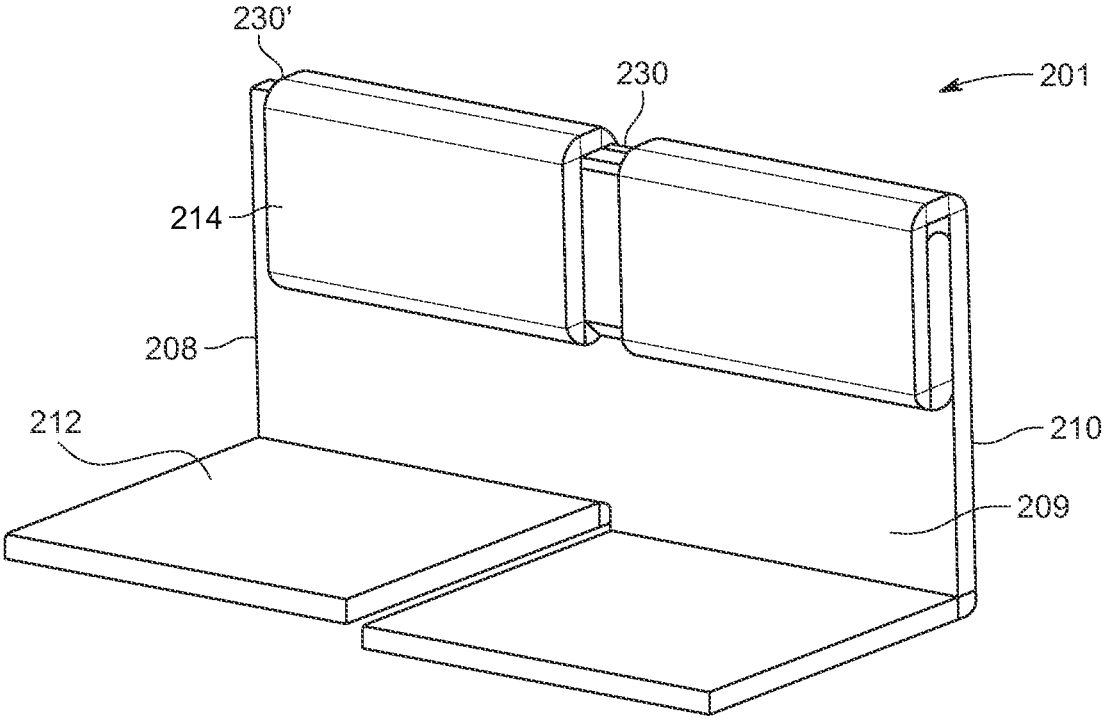
Figure 3D:
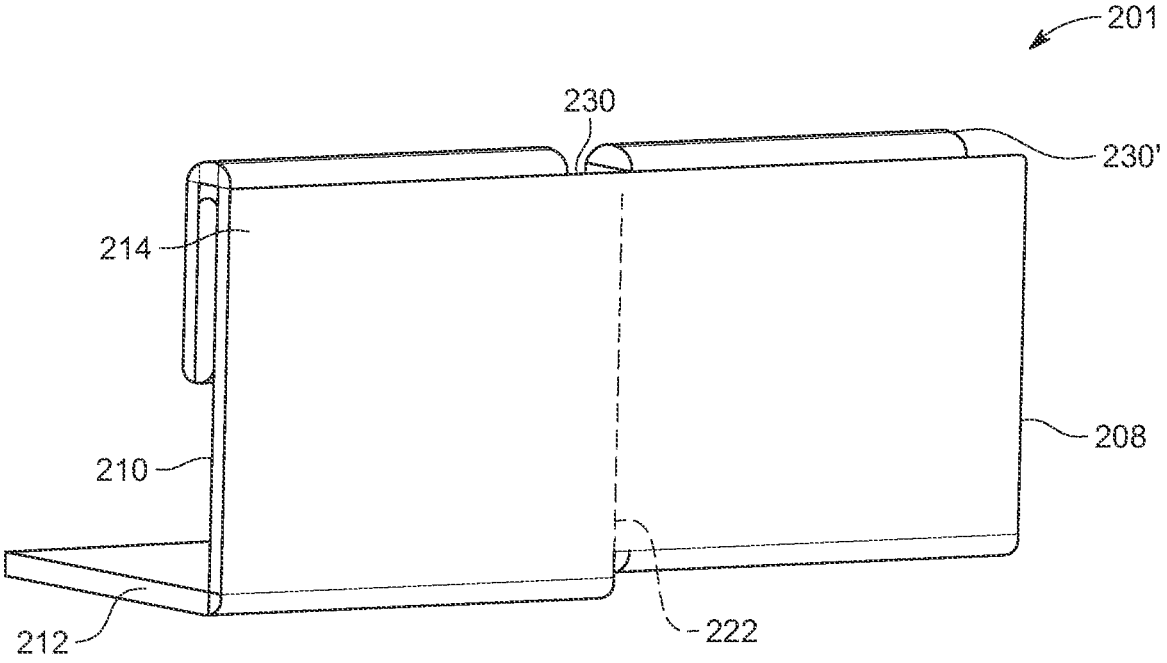
Figure 3E:
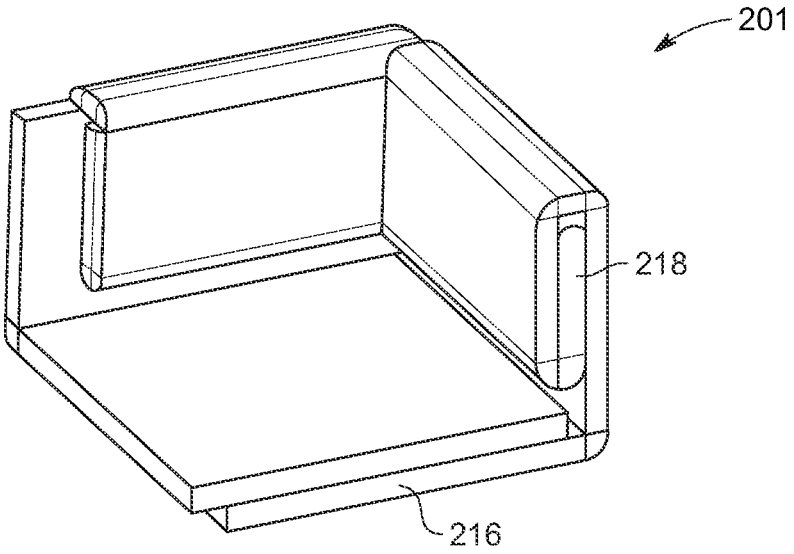
Figure 3F:
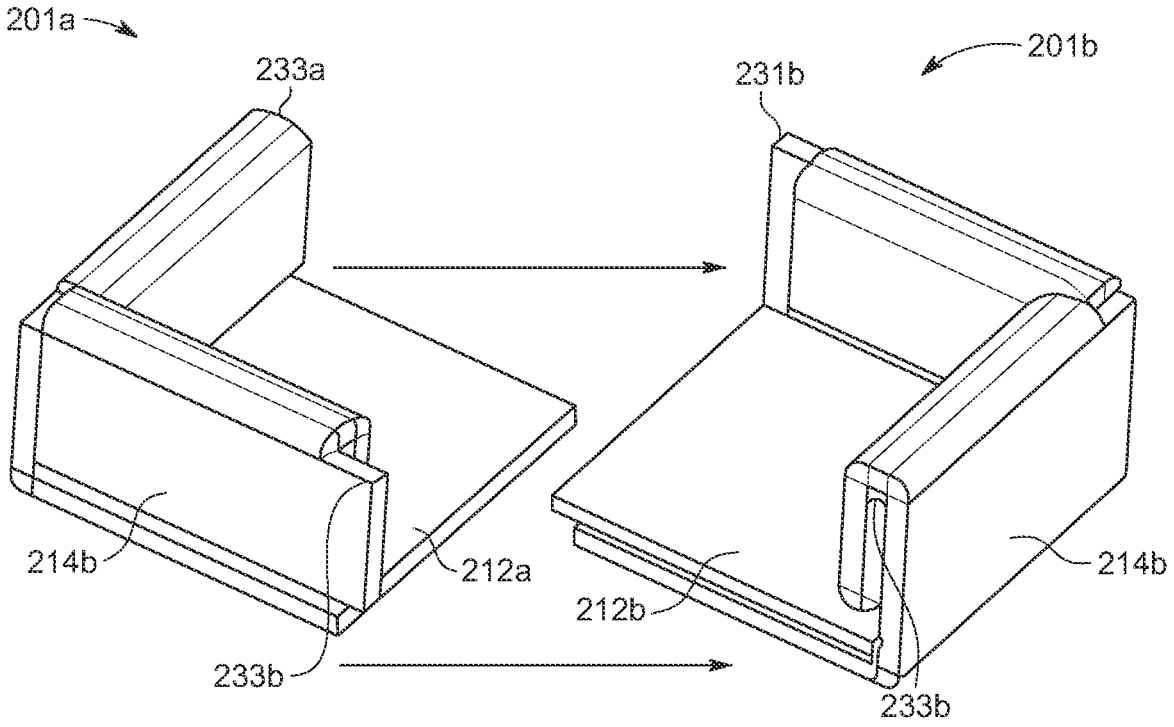

FIG. 3A shows an insert portion 201 as an unfolded piece of stock cellulose material, FIGS. 3B-3D illustrate the insert 200 at various stages of an example folding process for converting the stock cellulose material into a folded insert portion 201, FIG. 3E illustrates a finalized folded insert portion 201, and FIG. 3F illustrates connection of two insert portions 201 to form a finalized folded insert 200 suitable for insertion into a container.

As with insert 100, insert portion 201 includes an upper edge 204, a lower edge 206, a left edge 208, and a right edge 210. The vertical direction (V) and lateral direction (L) are defined as before. The illustrated insert portion 201 includes a single folding slots 220. The folding slot 220 begins at the lower edge 206 and extends in the vertical direction toward the upper edge 204 until reaching a folding slot terminus 221. The folding slot 220 defines a vertical fold line 222 that extends from the folding slot terminus 221 in the vertical direction toward the upper edge 204.

The folding slot 220 also defines two primary lateral fold line 224 (best seen in FIG. 3B). Each primary lateral fold line 224 extends in the lateral direction from the folding slot terminus 221 toward the left edge 208 and the right edge 210, respectively. Sections of the insert portion 201 disposed below the primary lateral fold lines 224 are defined as bottom sections 212, and sections above respective primary lateral fold lines 224 are defined as sidewall sections 214. In the illustrated embodiment, each primary lateral fold line 224 is vertically offset from the other. In other words, the distance from the lower edge 206 is different for each primary lateral fold line 224, and the distance from the upper edge 204 is different for each primary lateral fold line 224.

The vertical offset distance from one primary lateral fold line 224 to the other may be approximately the thickness of the stock cellulose material used to form the insert portion 201. This beneficially allows the bottom sections 212 to layer with each other when the insert portion 201 is converted to the folded configuration.

The illustrated insert portion 201 also includes a pair of cutouts 230. As shown, the cutout 230 may be vertically aligned with the folding slot 220 (and thus the corresponding vertical fold line 222). One of the cutouts 230 is an edge cutout 230' that is partially coincident with one of the side edges of the insert portion 201 (the left edge 208, in this example). The edge cutout 230' is thus open to one side but otherwise functions as the other cutout 230. The general reference to cutout(s) 230 will thus be inclusive of the edge cutout 230' unless specified otherwise.

The cutouts 230 are disposed to be positioned at a corner edge of the sidewall 218 when the insert portion 201 is formed into the folded configuration. The cutouts 230 are wider (in the lateral direction) than the folding slot 220. The cutouts 230 provides clearance to enable folding of adjacent sections of the insert portion 201 along the vertical fold line 222 such that there is sufficient clearance to form the corner edge where adjacent sections of the sidewall 218 meet.

The cutouts 230 of the illustrated embodiment are disposed between the primary lateral fold lines 224 and the upper edge 204. As shown, the non-edge cutout 230 does not extend to the upper edge 204, whereas the edge cutout 230' does extend to the upper edge 204. One, both, or neither of the cutouts 230 can extend all the way to the upper edge 204 to form an open end. The cutouts 230 are typically the same size, though other embodiments may include cutouts 130 of different size.

A distance between the upper edge of the cutouts 230 and the upper edge 204 of the insert portion 201 is equal to or less than the length of the cutouts 230. Similarly, a distance between the lower edge of the cutouts 230 and the primary lateral fold lines 224 is equal to or less than the length of the cutouts 230. Positioning the cutouts 230 in this manner with respect to the primary lateral fold lines 224 and the upper edge 204 ensures that the cutouts 230 will be located at the corner edges of the sidewall 218 when the insert portion 201 is folded.

With reference to FIG. 3A, the insert portion 201 includes an upper secondary fold line 226 substantially aligned with the upper edge of the cutouts 230. The upper secondary fold line 226 extends laterally from the left edge 208 to the right edge 210 of the insert portion 201. Folding the stock cellulose material of the insert portion 201 along the upper secondary fold line 226 provides the configuration shown in FIG. 3B. As shown, folding along the upper secondary fold line 226 essentially functions to add another layer to the sidewall sections 214.

With reference to FIG. 3B, the insert portion 201 includes a lower secondary fold line 228 substantially aligned with the lower edge of the cutout 230. The lower secondary fold line 228 extends laterally from the left edge 208 to the right edge 210 of the insert portion 201. Folding the stock cellulose material along the lower secondary fold line 228 and along the primary lateral fold lines 224 (by approximately 90° to bring each bottom section 212 upward toward its corresponding sidewall section 214) provides the configuration shown in FIGS. 3C and 3D.

As shown in FIGS. 3C and 3D, the sidewall sections 214 now have three layers, except at the area corresponding to the cutouts 230. FIG. 3C shows a front perspective view, whereas FIG. 3D shows a rear perspective view, of the insert portion 201 at this stage of the folding process. These views illustrate that the bottom sections 212 are offset in height from one another as a result of the vertical offset between each of the primary lateral fold lines 224.

The sidewall sections 214 of the illustrated embodiment include a neck section 209 disposed below the multi-layered portion of the sidewall sections 214 and extending to the bottom sections 212. The neck section 209 may be utilized to provide clearance for receiving bottom sections 212 of another insert portion 201, as shown in FIG. 3F. Alternatively, the neck section 209 can be omitted or reduced in height. In some embodiments, the sidewall sections 214 may be folded one or more additional times to incorporate the neck section 209 into another layer of the sidewall sections 214.

From the configuration of FIGS. 3C and 3C, the insert portion 201 may be folded inward along the vertical fold line 222 to layer the bottom sections 212 together and to bring the sidewall sections 214 together and form the folded configuration of the sidewall portion 201 as shown in FIG. 3E. The gap corresponding to the cutout 230 provide space for the multi-layered portions of the sidewall sections 214 to contact each other during folding and form a full, essentially gapless corner edge. The folded configuration shown in FIG. 3E thus includes a sidewall 218 with three layers of the stock cellulose material and a bottom 216 with two layers of the stock cellulose material.

FIG. 3F illustrates the combining of two insert portions 201*a* and 201*b* to form a combined insert 200 suitable for insertion into a container. The bottom sections 212*a*, 212*b* of the separate insert portions 201*a*, 201*b* may be layered on top of another to form a combined bottom 216 with four layers. The bottom sections 212*a*, 212*b* may be alternately layered with one another, for example, or simply layered two over two. In other words, from top to bottom, the layers of the combined bottom 216 may include a bottom section 212*a* from the first insert portion 201*a*, a bottom section 212*b* from the second insert portion 201*b*, another bottom section 212*a* from the first insert portion 201*a*, and lastly another bottom section 212*b* from the second insert portion 201*b*. Alternatively, from top to bottom, the layers of the combined bottom 216 may include a bottom section 212*a* from the first insert portion 201*a*, another bottom section 212*a* from the first insert portion 201*a*, a bottom section 212*b* from the second insert portion 201*b*, and lastly another bottom section 212*b* from the second insert portion 201*b*.

The sidewall sections 214*a*, 214*b* of the separate insert portions 201*a*, 201*b* may be aligned so that receiving sidewall edges 231*a* and 231*b* (corresponding to the respective edge cutouts 230') receive the multi-layered sidewall edges 233*a* and 233*b* of the opposing insert portion 201*a*, 201*b*. In other words, the receiving sidewall edge 231*a* of the first insert portion 201*a* is contacted with the multi-layered sidewall edge 233*b* of the second insert portion 201*b*, whereas the receiving sidewall edge 231*b* of the second insert portion 201*b* is contacted with the multi-layered sidewall edge 233*a* of the first insert portion 201*a*. The resulting insert 200 is similar to the insert 100 and can be similarly used to insulate a container as described above with reference to FIGS. 1A and 1B.

Example Cellulose Material Construction

Figures 4A, 4B:
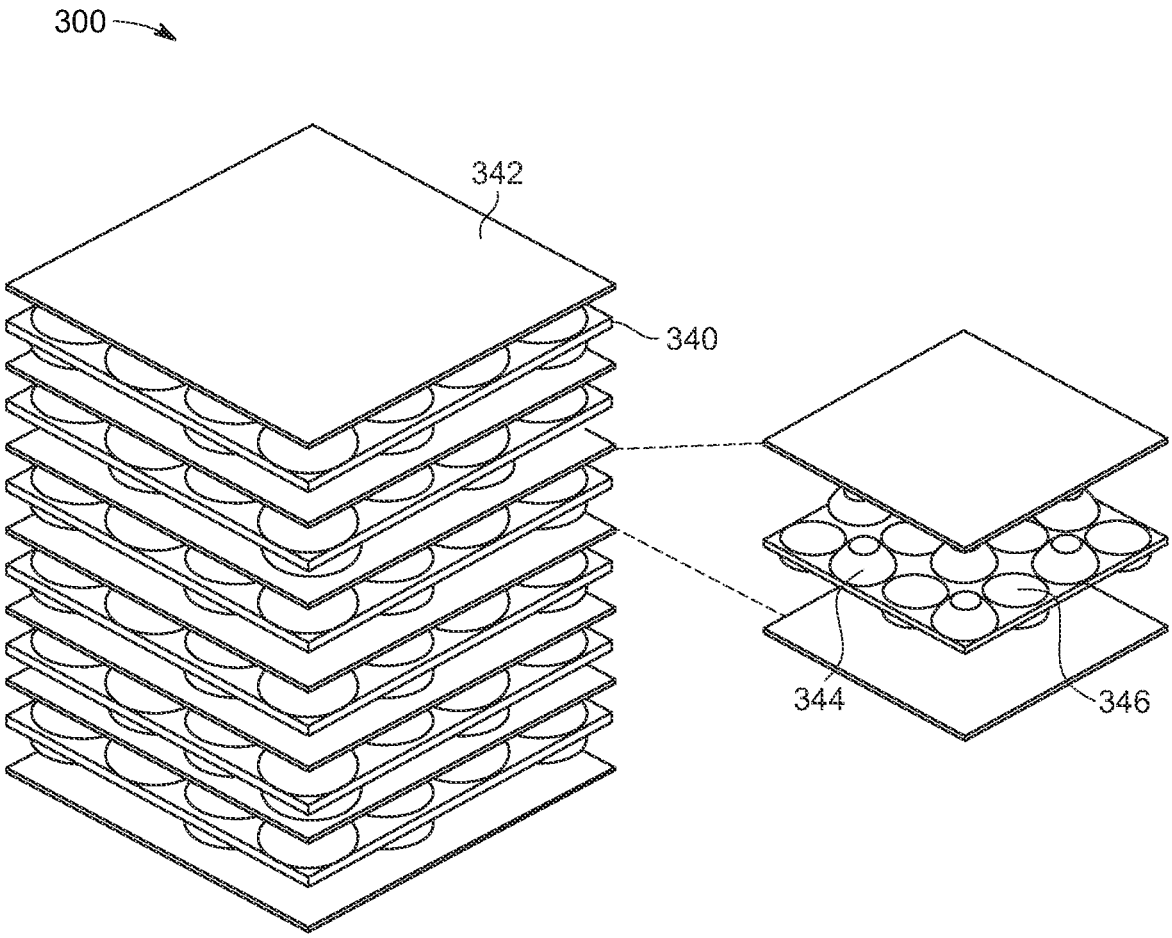
FIGS. 4A and 4B illustrate a multi-layered paperboard material that may be utilized to form the insulative liners disclosed herein, the multi-layered material including alternating layers of embossed sheets and flat sheets connected to form an effective insulative cellulose material.

FIGS. 4A and 4B illustrate an example paperboard material 300 that may be utilized to form the insulative liners disclosed herein. In preferred embodiments, the material 300 is utilized as the stock cellulose material for any of the inserts illustrated in FIGS. 2A-3F. For example, the unfolded inserts of FIGS. 2A and 3A may be formed from the material 300. The material 300 includes multiple layers. The various layers of the material 300, described in more detail below, are therefore distinct from the layers formed because of folding of the stock cellulose material to convert to the final folded configuration. In other words, while folding of the stock cellulose material can form different layers in the insert, the stock cellulose material can itself include multiple layers formed from different sheets.

The illustrated material 300 includes alternating layers of embossed sheets 340 and flat sheets 342 connected to form an effective insulative stock cellulose material. In the illustrated embodiment, as best shown in FIG. 4B, the embossed sheets 340 include first embossings 344 that protrude upwardly (and thus form a downward-facing opening) and second embossings 346 that protrude downwardly (and thus form an upward-facing opening).

As shown in FIG. 4B, the first and second embossings 344, 346 can be arranged in an alternating fashion in rows and columns such that along a given row or column, the embossings alternate in which direction they protrude. Other embodiments may include other embossed configurations. For example, some embodiments may include embossings that all (or substantially all) protrude in the same direction. Some embodiments may include embossings that protrude in different directions, but that aren't arranged to alternate along rows and columns of a grid pattern. For example, some embodiments may alternate according to row only, column only, some other pattern, or even randomly. Although embossings 344, 346 are depicted as having a semi-spherical shape, other suitable shapes are also possible.

The sheets 340, 342 may have a thickness that is less than 1 mm, 0.5 mm, 0.4 mm, 0.25 mm or 0.15 mm, or is in a range between any two of the foregoing values. Other thicknesses may also be used. One common way to measure paper is "lb. bond," which is the pound weight per 500 sheets. In some embodiments, the sheets 340, 342 can have a lb. bond measurement that is about 5, 10, 15, 20, 25, or 30, or is in a range between any two of the foregoing values. Other measurements can also be used.

The alternating embossed sheets 340 and flat sheets 342 may be secured together by an adhesive. Any desired number of alternating layers of flat sheets 3421 and embossed sheets 340 can be used. For example, the total number of vertically stacked sheets that are secured together may be about 3, 5, 10, 15, 20, 25, or 30 sheets, or in a range between any two of the foregoing values.

The illustrated cellulose material 300 beneficially includes small, isolated cavities in which air pockets are generated, thereby improving the thermal efficiency of the material 300. The structure of material 300 also functions to restrict the flow of air. Further, as a result of securing the sheets 340, 342 together by an adhesive, the material 300 has improved rigidity and thereby reduces the probability that the cavities or pockets will be compressed or otherwise disrupted during use of a packaging system incorporating the material 300.

Figure 5:
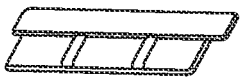
FIG. 5 compares a manufacturing process for forming a prior sleeve-based insulative insert ("Insert A") with a manufacturing process for forming an insulative insert as described herein ("Insert B")
Figure 5:
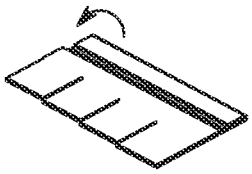
Figure 5:
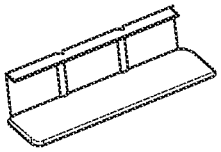
Figure 5:
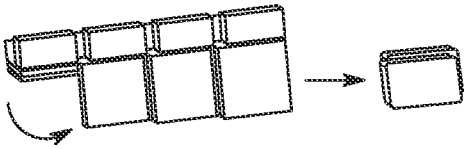
Figure 5:
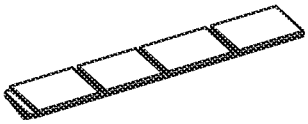
Figure 5:
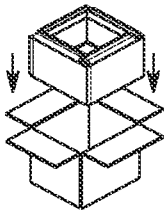
Figure 5:
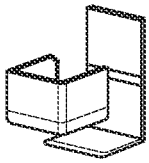
Figure 5:
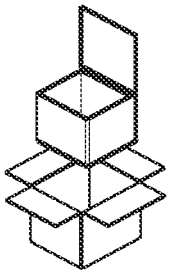

FIG. 5 compares a manufacturing process for forming the sleeve-based insulative insert described in US 2021/0253330 (See, e.g., liner 14A described therein) ("Insert A") with a manufacturing process for forming an insulative insert as described herein in FIGS. 2A-2G ("Insert B"). As shown, forming Insert A requires an initial folding step (Step 1), a step of inserting insulation sheets (Step 2), a step of folding the outer sleeve around the sheets and gluing the sleeve in the enclosed configuration (Step 3), a step of folding separate liner portions and connecting them to form a completed liner (Step 4), and a step of placing the insulative material of the completed liner into a container/box (Step 5).

In contrast, forming Insert B includes an initial folding step comprising folding along lateral fold lines (Step 1), a step of folding along the vertical fold lines to layer the bottom sections together (i.e., via a "rolling technique") (Step 2), and a step of placement of the completed insulative liner into a container/box (Step 3). The insulative liner described herein can therefore be manufactured in a simpler and faster manner. This beneficially reduces manufacturing time and costs. Further, because Insert B does not require glue or other adhesives, unlike Insert A, the overall manufacturing process for Insert B is less complex and more amenable to automation. That is, even if the illustrated manufacturing processes are automated, the automated process for Insert B is simpler and likely less equipment intensive.

Moreover, a comparison of Insert A to Insert B shows that Insert B uses 10% to 30% less material (e.g., less paperboard material) to form otherwise similarly sized liners. The insulative liners disclosed herein therefore beneficially provide improved insulative performance with less material and less potential waste, in addition to the manufacturing benefits disclosed above.

Additional Terms & Definitions

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

EXAMPLES

Example 1

The insulative properties of a prior cellulose-based insulative packaging liner was compared to a material corresponding to the cellulose material 300 described herein. The prior liner included a paperboard "sleeve" bounding multiple layers of "insulation sheets" formed from a thinner paper material. The prior liner is described in US 2021/0253330 (see, e.g., liner 14A described therein). These materials were also compared against a standard EPS material as used in conventional "Styrofoam coolers." A two-inch wall thickness was used for each material to determine respective R values.

Figure 6:
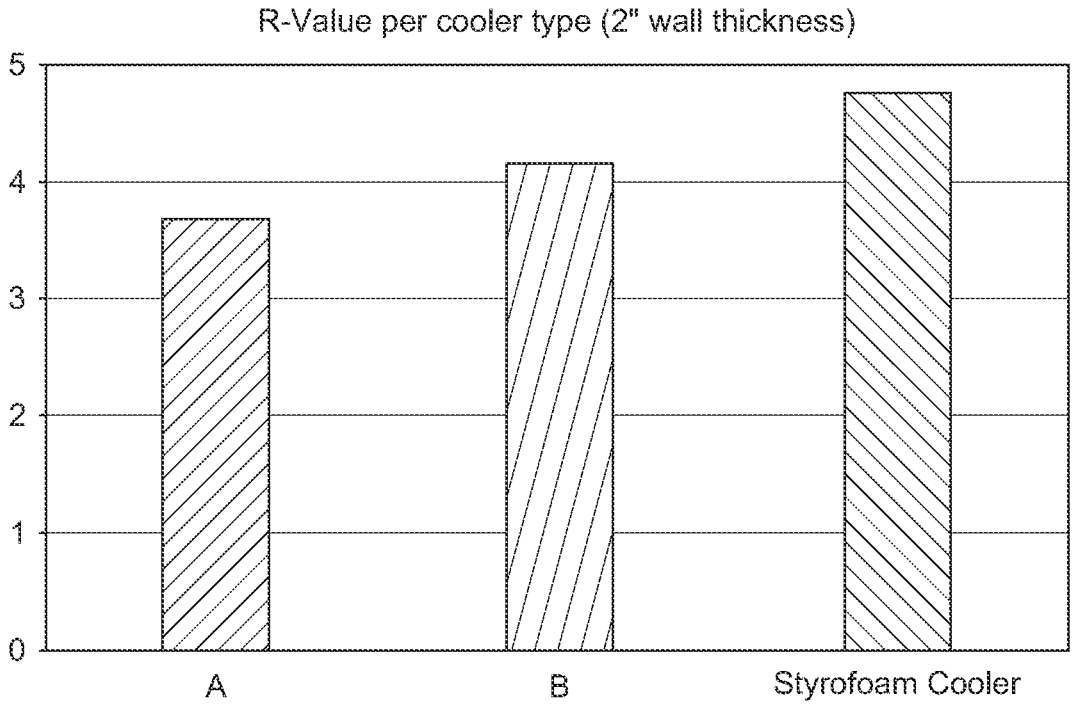
FIG. 6 shows the results of a comparison of insulative properties of a prior cellulose-based insulative packaging liner and a cellulose material used in the insulative packaging systems described herein.

Results are shown in FIG. 6. The "A" material represents the prior liner described in US 2021/0253330. The "B" material represents the material 300 described herein. As shown, the material 300 provided a higher R value as compared to the prior liner, providing performance closer to that of a standard Styrofoam cooler EPS material.

Example 2

Figure 7:
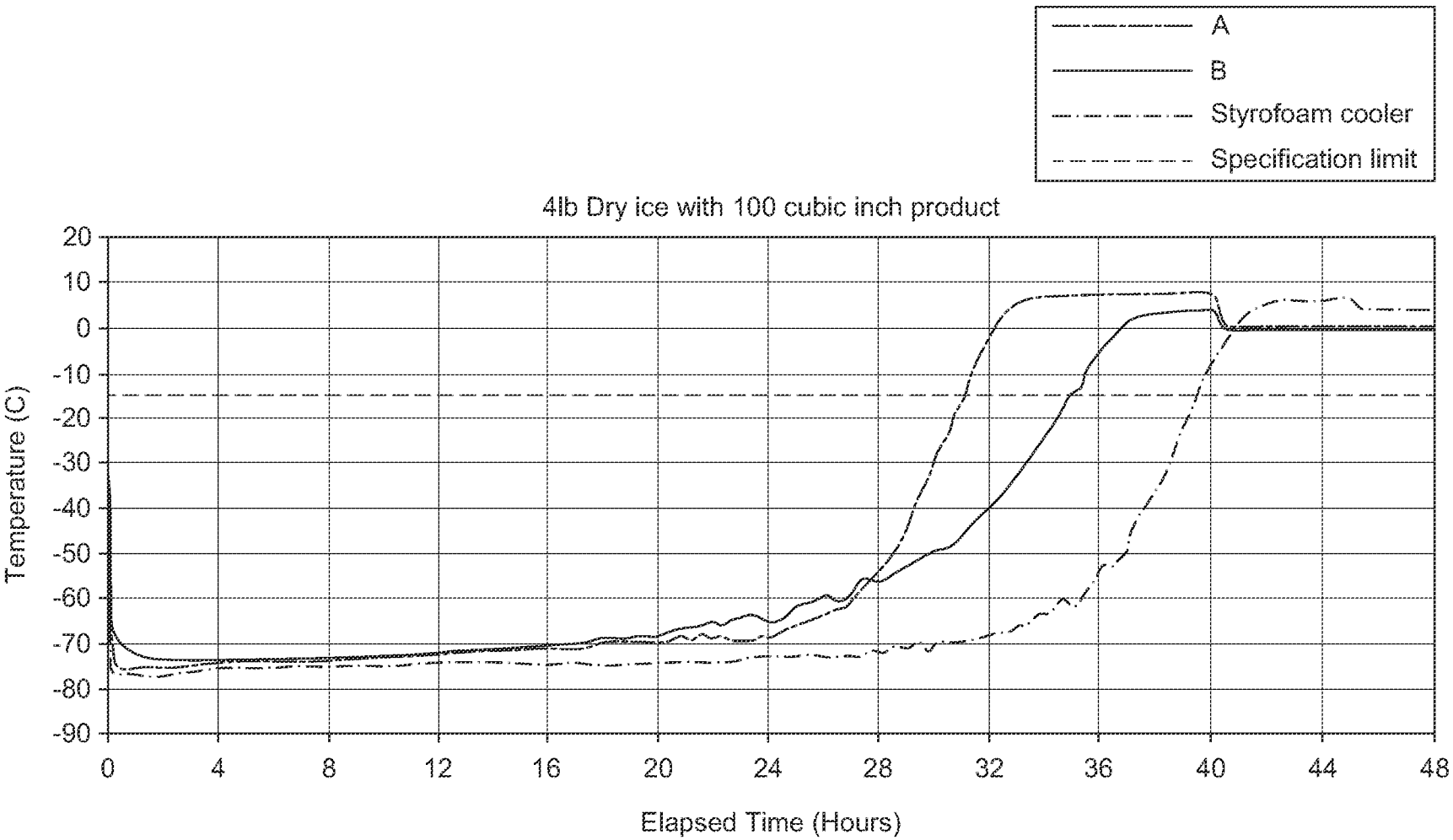
FIG. 7 is a graph that plots temperature over time for prior packaging configuration that incorporated a sleeve-based liner (A), an otherwise similar packaging system that incorporated the insulative insert as described herein (B), and a similarly sized standard Styrofoam cooler.

FIG. 7 is a graph that plots temperature over time for a packaging configuration that incorporated the sleeve-based liner described in US 2021/0253330 (A), an otherwise similar packaging system that incorporated the insulative insert as described herein (B), and a similarly sized standard Styrofoam cooler. Each packaging configuration included 4 pounds of dry ice and a volume of 100 cubic inches. The specification limit was set at −15° C. The time taken for the insulated volume to surpass the specification limit was measured.

As shown, the packaging system (B) using the insulative insert as described herein outperformed the packaging system (A) based on the prior sleeve-based liner. Specifically, while the packaging system (A) based on the prior sleeve-based liner surpassed the specification limit at approximately 31 days, the packaging system (B) using the insulative insert as described herein did not surpass the specification limit until approximately 35 days.

What is claimed is:

1. A packaging insert formed from a cellulose material and configured for insulating a container, the packaging insert comprising:

a single panel of cellulose material having an upper edge and a lower edge defining a vertical direction extending therebetween;

a left edge and a right edge defining a lateral direction extending therebetween; and a plurality of internal folding slots, wherein each folding slot begins at the lower edge and extends toward the upper edge until reaching a folding slot terminus, each folding slot defining a vertical fold line extending from the terminus toward the upper edge in the vertical direction, each folding slot defining a primary lateral fold line extending from the terminus toward the left or right edge in the lateral direction, wherein sections below respective primary lateral fold lines are defined as a plurality of contiguous bottom sections and sections above respective primary lateral fold lines are defined as sidewall sections, wherein the plurality of internal folding slots are arranged with successively shorter or longer lengths such that the primary lateral fold lines are successively lower or higher, wherein the insert is configured such that folding along the primary lateral fold lines and along the vertical fold lines forms a folded configuration with a sidewall formed by the sidewall sections and a bottom formed by sequentially layering the contiguous bottom sections, the insert being insertable into a container when in the folded configuration.

2. The packaging insert of claim 1, wherein the primary lateral fold lines enable corresponding bottom sections to layer with each other when the insert is folded along the primary lateral fold lines and the vertical fold lines, and wherein when the insert is formed into the folded configuration, the bottom of the insert has at least 3-layers.

3. The packaging insert of claim 1, further comprising one or more cutouts, wherein the one or more cutouts are each vertically aligned with a corresponding folding slot and along a corresponding vertical fold line.

4. The packaging insert of claim 3, wherein the one or more cutouts are each disposed to be positioned at a corner edge of the sidewall when the insert is formed into the folded configuration.

5. The packaging insert of claim 3, wherein the one or more cutouts are disposed between the primary lateral fold lines and the upper edge of the insert.

6. The packaging insert of claim 3, wherein the one or more cutouts have a lower edge, an upper edge, and a length in the vertical direction, and wherein for each cutout, a distance between the upper edge of the cutout and the upper edge of the insert is equal to or less than the length of the cutout and a distance between the lower edge of the cutout and a corresponding primary lateral fold line is equal to or less than the length of the cutout.

7. The packaging insert of claim 1, further comprising at least two secondary lateral fold lines, wherein each secondary lateral fold line extends between the left edge and the right edge of the insert.

8. The packaging insert of claim 7, wherein the secondary lateral fold lines enable the resulting sidewall sections to have multiple layers, wherein the sidewall sections include at least 3 layers when the insert is formed into the folded configuration.

9. The packaging insert of claim 8, wherein the sidewall includes two adjacent sections when formed into the folded configuration.

10. The packaging insert of claim 1, wherein the insert consists of three internal folding slots.

11. The packaging insert of claim 1, wherein the cellulose material comprises at least one flat sheet and at least one embossed sheet.

12. The packaging system of claim 11, wherein the cellulose material is arranged in alternating layers of embossed sheets and flat sheets.

13. The packaging insert of claim 1, further comprising a coating at least partially disposed on inner surfaces of the insert when formed into the folded configuration.

14. An insulative packaging system, comprising:

a packaging container; and at least one packaging insert, the packaging insert comprising:

a single panel of cellulose material having an upper edge and a lower edge defining a vertical direction extending therebetween;

a left edge and a right edge defining a lateral direction extending therebetween; and a plurality of internal folding slots, wherein each folding slot begins at the lower edge and extends toward the upper edge until reaching a folding slot terminus, each folding slot defining a vertical fold line extending from the terminus toward the upper edge in the vertical direction, each folding slot defining a primary lateral fold line extending from the terminus toward the left or right edge in the lateral direction, wherein sections below respective primary lateral fold lines are defined as a plurality of contiguous bottom sections and sections above respective primary lateral fold lines are defined as sidewall sections, wherein the plurality of internal folding slots are arranged with successively shorter or longer lengths such that the primary lateral fold lines are successively lower or higher, wherein the insert is configured such that folding along the primary lateral fold lines and along the vertical fold lines forms a folded configuration with a sidewall formed by the sidewall sections and a bottom formed by sequentially layering the contiguous bottom sections, the insert being insertable into a container when in the folded configuration.

15. The packaging system of claim 14, wherein multiple inserts are arranged within the container to form a complete liner.

16. The packaging system of claim 14, wherein the packaging insert comprises at least two packaging inserts, wherein each packaging insert is configured to form a folded configuration including a sidewall formed by sidewall sections, and wherein the at least two packaging inserts are configured to form a combined insert having a sidewall with four sections and a combined bottom having four layers formed from bottom sections of the at least two packaging inserts.

17. The packaging system of claim 14, the system comprising a single insert.

* * * * *